US005365955A

United States Patent [19]

Desgroux et al.

[11] Patent Number: 5,365,955

[45] Date of Patent: Nov. 22, 1994

[54] HAIR CLIP MOUNT

[75] Inventors: Michel Desgroux, Esvres; Guy Pignon, Vouneuil sous Biard Poitiers; Denis Weber, Dissay, all of France

[73] Assignee: Etablissements DELSOL, Paris, France

[21] Appl. No.: 26,448

[22] Filed: Mar. 4, 1993

[30] Foreign Application Priority Data

Mar. 13, 1992 [FR] France ..... 92 03003

[51] Int. Cl.[5] ..... A45D 8/22

[52] U.S. Cl. ..... 132/279; 132/278

[58] Field of Search ..... 132/278, 279

[56] References Cited

U.S. PATENT DOCUMENTS

| | | | |
|---|---|---|---|
| 2,921,589 | 1/1960 | Blomme | 132/279 |
| 3,565,084 | 2/1971 | Vuillard | 132/279 |
| 3,805,813 | 4/1974 | Laughton | 132/279 |
| 4,976,277 | 12/1990 | Yasude | 132/279 |

FOREIGN PATENT DOCUMENTS

| | | | |
|---|---|---|---|
| 1222694 | 6/1960 | France | 132/279 |
| 2170290 | 9/1973 | France . | |
| 2224103 | 10/1974 | France | 132/279 |
| 2635653 | 3/1990 | France | 132/279 |
| 0440897 | 10/1949 | Italy | 132/279 |
| 2215202 | 9/1989 | United Kingdom | 132/278 |

*Primary Examiner*—Gene Mancene
*Assistant Examiner*—Frank A. LaViola
*Attorney, Agent, or Firm*—Fitch, Even, Tabin & Flannery

[57] ABSTRACT

The closure of a hair clip comprises two curvilinear pressure tangs which are mobile relative to each other in the longitudinal direction. Their end parts overlap to define an overlap area. The two tangs are linked together in the overlap area to form a continuous loop facing a baseplate of the closure. A hair clip incorporating a mount of this type is easily adjusted in position and the hair is better distributed within it.

16 Claims, 1 Drawing Sheet

HAIR CLIP MOUNT

BACKGROUND OF THE INVENTION

1. Field of the invention

The present invention concerns a mount for a "pony-tail" type hair clip.

2. Description of the Prior Art

The invention is more particularly concerned with an improvement to the closure of a mount as described in published French patent application N° 2 635 653. The prior art closure has a pressure member to clamp a bunch of hair comprising two separate curvilinear pressure tangs overlapping at their free end to define an overlap area. The advantage of this type of closure is that it secures the bundle of hair substantially symmetrically.

Unfortunately, it has been found that some hair can become trapped between the two tangs in the overlap area. As a result hairs may be pulled out, especially when the clip is removed, and if the clip is inadvertently fitted on the slant it may be difficult to straighten it.

Problems have also been encountered in manufacturing clips provided with a closure of this kind. During polishing and nickel-plating operations in which, for example, the clips are immersed in batches in an electrolytic plating bath, the clips tend to become entangled with each other at the free edge of the closure tangs.

An object of the present invention is to alleviate all of these problems.

SUMMARY OF THE INVENTION

The invention consists in a hair clip mount comprising a generally curved baseplate and a closure articulated to one end of said baseplate and adapted to be immobilized at the other end, said closure comprising an outer tang and facing said baseplate a pressure member comprising first and second curvilinear pressure tangs together reproducing the shape of said baseplate and having overlapping end parts defining an overlap area, said first and second tangs being mobile longitudinally relative to each other and linked together in said overlap area so that they form a continuous loop facing said baseplate.

A return is preferably formed at the end of one tang and incorporates a passage for the other tang whereby said tangs are linked together.

Said loop preferably starts in said hinge area, continues along a curved portion of said second tang, the straight wall formed by said return which links said two tangs and a curved portion of said first tang to end at a root area of said first tang.

Because the invention joins the two tangs together to form a continuous loop the gap between the two tangs in the overlap area is restricted. This solves the problem of the clips becoming entangled during manufacture and the problem of hair becoming trapped between the two tangs in the overlap area.

Likewise, a clip with a mount in accordance with the invention is easy to apply to the hair and, most importantly, easy to adjust in position.

Finally, a mount in accordance with the invention provides a better distribution of the individual hairs between the pressure member and the baseplate and the clip no longer tends to become skewed.

The present invention will be better understood from the following description given by way of example only and with reference to the appended drawings.

DETAILED DESCRIPTION OF THE INVENTION

Figure 3:
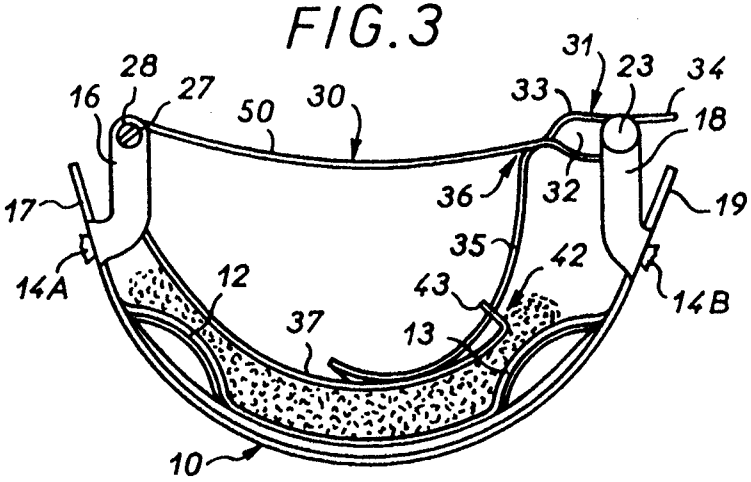
FIG. 3 is a side view of the hair clip when closed.
Figure 5:
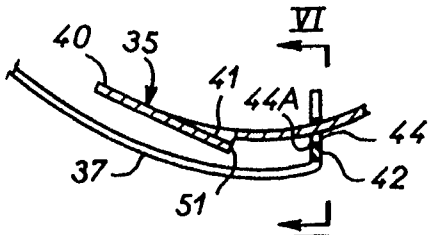
FIG. 5 is a view in cross-section on the line V—V in FIG. 4.
Figure 1:
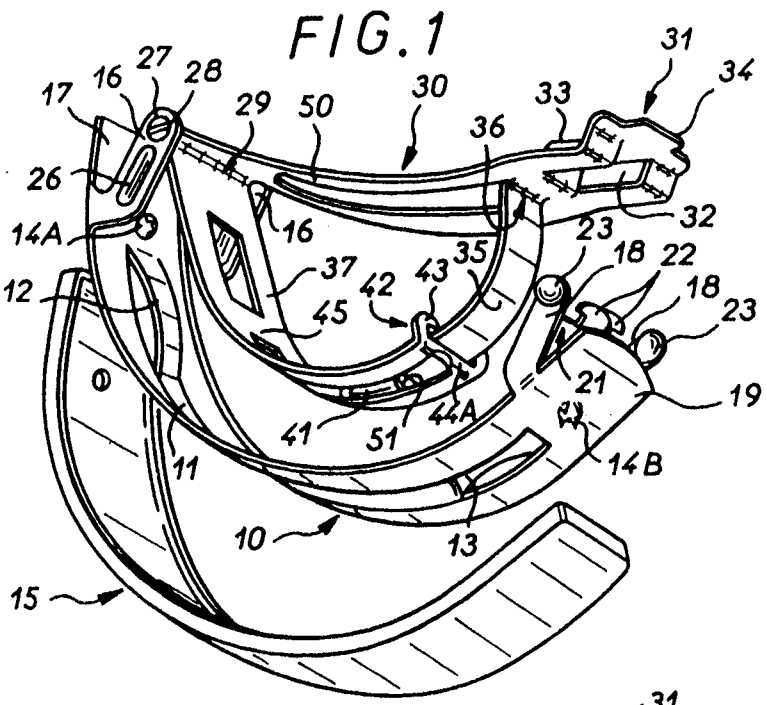
FIG. 1 is a perspective view of a hair clip mount shown semi-open and incorporating a closure in accordance with the invention and a decorative member which is shown separated from it.

In the embodiment shown in FIGS. 1 and 3 a "pony-tail" type hair clip mount comprises, in a manner that is known in itself, a baseplate 10 which is of generally semi-circular shape, for example, with a central stiffening rib 11 and extending between two bearing members 12 and 13 which are separated from the remainder of the strip by longitudinal cuts and which are curved so that they project radially towards the interior of the baseplate.

Stamped bosses 14A and 14B on the exterior of each bearing member 12, 13 are used in the usual way to fix a decorative member 15 to the outside of the baseplate.

Perforations may be used instead of these bosses, in which case the decorative member can be clipped or sewn on.

The baseplate has on each side of the boss 14A a pair of lateral hinge lugs 16, one on each side of an end part 17.

It similarly has on each side of the other boss 14B a pair of lateral locking lugs 18, one on each side of an end part 19.

The lugs 18 have respective arms 21 bent at right angles towards each other, partially overlapping and having two locking hooks 22. At their rounded and slightly diverging ends they have stamped portions 23 forming outwardly projecting operating knobs.

The hinge lugs 16 incorporate stiffener ribs 26 and have at their rounded end a perforation 27 forming a bearing for one of two nipples 28 constituting a hinge axis for the closure now to be described.

This closure 30 comprises a strip of elastic material extending to each side of a hinge area 29 defined by the nipples 28.

At the end opposite the hinge area 29 the closure forms an outer tang 50 ending in a latch 31 cut and stamped to define an aperture 32 and an overlying cover plate 33. There is an operating tab 34 at the end of the exterior tang 50.

Over the major part of its length between the hinge area 29 and the latch 31 the material of the closure is cut out to form a pressure tang 35 which in a root area 36 is bent substantially at right angles to the inside surface of the closure towards the baseplate and which in the direction away from the root area 36 is curved with a circular profile subtending an angle of approximately 90°. Note that the root area 36 is in the immediate vicinity of the latch 31.

Figure 4:
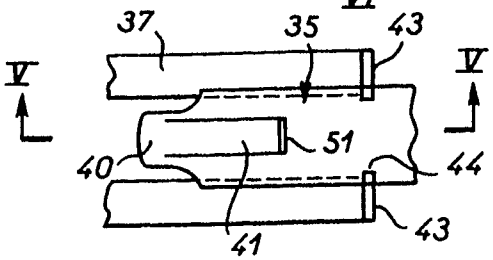
FIG. 4 is a view in cross-section in the plane identified by the arrow IV in FIG. 2.

Referring to FIG. 4, the tang 35 ends in a portion 40 of reduced cross-section. The end part of the tang 35 incorporates, between two longitudinal cuts, a deformation area 41 forming a ramp with a projecting part 51 facing away from the free end of the tang and facing towards the baseplate 10. Its edge provides an abutment.

Beyond the hinge area 29 the strip of elastic material forming the closure 30 lies at an acute angle to the adjacent part of the closure to form a second part-circular pressure tang 37 which partially overlaps the pressure tang 35.

Figure 6:
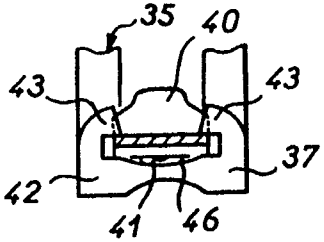
FIG. 6 is a view in cross-section on the line VI—VI in FIG. 5.

The second tang 37 ends at a return 42 formed by bending the free end of the tang substantially at right angles towards the interior of the closure. The return 42 terminates in two hooks 43 facing towards each other which partially enclose a passage 44 for the tang 35 in the return 42. The dimensions of the passage 44 are such that the tang 35 can be inserted and guided with lateral and transverse clearance. Moreover, referring to FIG. 6, the return 42 has facing the opening defined by the hooks 43 a shallow notch 46 enlarging the passage 44. The width of the opening between the hooks is naturally smaller than the width of the tang 35 so that the hooks are able to prevent separation of the two tangs 35 and 37 in a transverse direction towards the outer tang 50.

Likewise, the edge of the projecting part 51 in the end part of the tang 35 forming an abutment is adapted to prevent longitudinal separation of the two tangs. In this context "longitudinal" refers to displacement along the circular arc defined by the tangs 35 and 37.

If the closure is closed without any hair in the clip a transverse area 45 of the tang 37 comes into contact with the bearing member 12 of the baseplate 10 and so functions as a spring for opening the closure. If the operating knobs 23 are pressed in the closure pivots about the hinge area 29 and moves away from the baseplate automatically.

In another embodiment (not shown) the return spring function is achieved by direct bearing engagement of the tang 37 on the baseplate 10. The tang 37 has a longitudinal cut-out for this purpose. When the clip is closed the bearing member 12 enters this cut-out in such a way that the outer surface of the tang bears on the inner surface of the baseplate 10.

In a further embodiment (also not shown) the return spring function is achieved by bearing engagement on the end part 17 of the closure of a lug formed as an extension of the outer tang 50 and bent at an obtuse angle to the end part 17, as described in the previously mentioned published French patent application N° 2 635 653.

On either side of the transverse area 45, on one side as far as the hinge area 29 and on the other as far as the vicinity of the return 42, the tang 37 is cut out to enhance its elasticity and reduce the weight of the clip.

At the same end as the return 42 the edge of the cut-out in the tang is rounded to define a bending line to facilitate formation of the return 42 during manufacture.

During the operation to cut out the part 30 the end of the tang 35 is introduced automatically into the passage 44 of the tang 37 by bending the tang 35 slightly so that the abutment member 51 passes through the passage 44. This is facilitated by the presence of the notch 46 (see FIG. 6).

Figure 2:
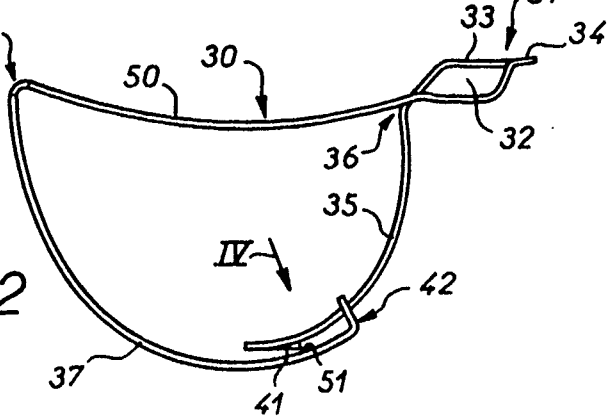
FIG. 2 is a side view of the closure.

The tang 35 remains inserted in the passage 44 so that the abutment member 51 is not in contact with the return 42 but set back short of the latter (see FIG. 2). This abutment member forms an obstacle to separation of the tangs in the longitudinal direction without preventing their movement.

The two tangs are thus assembled slidably, with the end part of the tang 37 capping the end part of the tang 35 (see FIGS. 2 and 3). The main part of the tang 35 constitutes a male part and the passage 44 and the overlap area of the tang 37 constitute a female part.

When the clip is closed the edge of the wall 44A of the passage 44 opposite the opening defined between the hooks 43 provides a bearing point to cause bending of the tang 35. This also provides a perfect join between the tang 35 and the wall formed by the return to prevent any hair getting into the passage 44.

FIG. 3 shows a clip with a bunch of hair (shaded area) trapped in the space between the pressure member comprising the two tangs 35 and 37 and the outer tang 50 of the baseplate 10. Note that on the tangs side the hair is in contact with a continuous loop which starts in the hinge area 29, continues along the curved portion of the tang 37 and then the straight wall consisting of the return 42 which links the two tangs and finally along the curved portion of the tang 35 to end at the root area 36 of the tang 35. This prevents the hair slipping between the two tangs. A direct consequence of this is that the hair cannot become wedged in place and it is therefore very easy to adjust the position of the hair clip.

Note that the provision of a wall to block access to the gap between the tangs and at the free ends of the latter prevents the previously mentioned entangling closures one with another.

It goes without saying that the present invention has been described by way of non-limiting explanation only and that the closure may be embodied in various ways.

For example, the male and female parts providing the coupling between the two tangs may be on either tang. The passage 44 in the tang 37 may be a simple perforation adapted to the size of the tang 34. The return 42 on the tang 37 may be spaced from the free end and may be a separate part attached to the device. The tang 37 need not be cut out longitudinally.

There is claimed;

1. A hair clip mount, comprising: a generally curved baseplate, a closure member having one end articulated to the baseplate and another latching end, said closure member comprising an outer tang and, facing the baseplate and having the same general curvature as the baseplate, a pressure member, said pressure member comprising first and second tangs extending towards each other and having overlapping end portions, said first and second tangs of the pressure member being longitudinally moveable relative to each other, and means interconnecting said first and second tangs of the pressure member for preventing separation of said tangs from each other.

2. A hair clip mount according to claim 1, wherein said first and second tangs of the pressure member have respective surfaces of curvature, said interconnecting means preventing separation of said first and second tangs generally at right angles to their respective surfaces of curvature thereof.

3. A hair clip mount according to claim 1, wherein said interconnecting means are integrally formed with at least one of the first and second tangs of the pressure member.

4. A hair clip mount according to claim 1, wherein said interconnecting means comprises a passage through which extends one of said first and second tangs of the pressure member.

5. A hair clip mount according to claim 1, wherein said overlapping portion of said first tang of the pressure member lies behind the overlapping end portion of said second tang of the pressure member relative to said closure member, and said overlapping portion of said second tang lies behind said overlapping of said first tang relative to said baseplate, said interconnecting means including at least one portion extending from said first tang to the side of the second tang remote from said baseplate.

6. A hair clip mount according to claim 1, wherein said interconnecting means is defined in a free end zone on one of the overlapping end portion, the free end zone extending around longitudinal edges of the other overlapping portion.

7. A hair clip mount according to claim 1, wherein first and second tangs of the pressure member together define a loop extending from the one end of said closure member towards the other end of said closure member, said interconnecting means defining a zone of continuity on the side of said tangs facing said baseplate between said first and second tangs to impede a user's hair from being caught between said first and second tangs.

8. A hair clip mount according to claim 1, wherein said interconnecting means comprises hooking means extending from the side of said first tang facing said baseplate around longitudinal edges of said second tang to the remote side of said second tang relative to said baseplate.

9. A hair clip mount according to claim 8, wherein said hooking means comprises a pair of hooks facing each other and defining therebetween a passage for the second tang.

10. A hair clip mount according to claim 9, wherein said hooks are formed on an end portion of the first tang making a right angle bend with respect to the surface of the curvature of the first tang.

11. A hair clip mount according to claim 1, further comprising abutment means on one of said first and second tangs of the pressure member for preventing longitudinal separation of said first and second tangs from each other.

12. A hair clip mount according to claim 11, wherein said abutment means is provided on the overlapping portion of the second tang facing the overlapping portion of said first tang.

13. A hair clip mount according to claim 12, wherein said abutment means is adapted to abut against an end portion of said first tang adjoining said interconnecting means.

14. A hair clip mount according to claim 1, wherein said first tang comprises a resilient transverse area cooperable with a bearing member of said baseplate to define resilient return means for automatic opening of said closure member.

15. A hair clip mount according to claim 1, further comprising means for laterally guiding said first tang relative to said second tang during relative longitudinal displacement thereof.

16. A hair clip mount, comprising: a generally curved baseplate and a closure articulated to one end of said baseplate and adapted to be immobilized at the other end, said closure comprising an outer tang and facing said baseplate a pressure member comprising first and second pressure tangs having respective surfaces of curvature generally following the shape of said baseplate and having overlapping end parts defining an overlap area, said first and second tangs being mobile longitudinally relative to each other and linked together in said overlap area so that they form a continuous loop facing said baseplate, one of the end parts of one of the first and second tangs having two facing hooks defining a passage for slidable receipt of the other of the first and second tangs to prevent separation of said first and second tangs at generally right angles to the surfaces of curvature thereof.

* * * * *